US010323889B2

(12) United States Patent
Bruemmer et al.

(10) Patent No.: US 10,323,889 B2
(45) Date of Patent: Jun. 18, 2019

(54) CONTAINER FOR A WASTE HEAT UTILIZATION CIRCUIT

(71) Applicant: Mahle International GmbH, Stuttgart (DE)

(72) Inventors: Richard Bruemmer, Stuttgart (DE); Eberhard Pantow, Winnenden (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/749,115

(22) PCT Filed: Jul. 28, 2016

(86) PCT No.: PCT/EP2016/068072
§ 371 (c)(1),
(2) Date: Jan. 30, 2018

(87) PCT Pub. No.: WO2017/021282
PCT Pub. Date: Feb. 9, 2017

(65) Prior Publication Data

US 2018/0224224 A1 Aug. 9, 2018

(30) Foreign Application Priority Data

Aug. 6, 2015 (DE) ..... 10 2015 215 063

(51) Int. Cl.
*F28F 19/00* (2006.01)
*E03B 11/00* (2006.01)
(Continued)

(52) U.S. Cl.
CPC ..... *F28F 19/002* (2013.01); *E03B 11/00* (2013.01); *F01K 9/00* (2013.01); *F01K 9/003* (2013.01);
(Continued)

(58) Field of Classification Search
CPC .. F28F 19/002; F28F 2250/08; F28F 2255/02; E03B 11/00; E03B 2011/005; F28D 21/0001; F28D 21/0003; F28D 2021/0063; F28D 2021/004; F01K 9/003; F01K 9/00; F01K 2011/005; F01K 25/00
USPC ..... 60/659; 165/104.31, 45, 902
See application file for complete search history.

(56) References Cited

U.S. PATENT DOCUMENTS 3,077,190 A * 2/1963 Allen ..... C02F 1/14 126/568
4,010,731 A * 3/1977 Harrison ..... F28D 20/0043 126/620
(Continued)

FOREIGN PATENT DOCUMENTS

DE 136280 C 11/1902
DE 102009050068 A1 4/2011
(Continued)

OTHER PUBLICATIONS

English abstract for DE-102009050068.

*Primary Examiner* — Hoang M Nguyen
(74) *Attorney, Agent, or Firm* — Fishman Stewart PLLC

(57) ABSTRACT

A container for a waste heat utilization circuit may include a housing that defines a housing interior such that the housing interior can be flowed through by a working medium. A sheath may be arranged in the housing interior for accommodating an auxiliary medium. The sheath may be fluid-tight and heat-conductive at least in certain areas. The sheath may define a sheath interior of variable volume.

20 Claims, 5 Drawing Sheets

(51) Int. Cl.

| | |
|---|---|
| ***F28D 21/00*** | (2006.01) |
| ***F01K 9/00*** | (2006.01) |
| *F01K 25/00* | (2006.01) |

(52) U.S. Cl.

CPC ..... *F28D 21/0001* (2013.01); *F28D 21/0003* (2013.01); *E03B 2011/005* (2013.01); *F01K 25/00* (2013.01); *F28D 2021/004* (2013.01); *F28D 2021/0063* (2013.01); *F28F 2250/08* (2013.01); *F28F 2255/02* (2013.01)

(56) References Cited

U.S. PATENT DOCUMENTS

| | | | | |
|---|---|---|---|---|
| 4,159,736 | A * | 7/1979 | Denis | E03B 1/02 165/104.31 |
| 4,294,311 | A * | 10/1981 | Denis | E03B 1/02 165/104.14 |
| 4,584,971 | A | 4/1986 | Neitz et al. | |
| 7,891,187 | B2 * | 2/2011 | Mohr | F28D 20/0056 60/641.2 |
| 8,800,285 | B2 | 8/2014 | Ernst et al. | |
| 2015/0135708 | A1 | 5/2015 | Lutz et al. | |

FOREIGN PATENT DOCUMENTS

| | | | |
|---|---|---|---|
| DE | 102012000100 | A1 | 7/2012 |
| DE | 102014223626 | A1 | 5/2015 |
| EP | 2573335 | A2 | 3/2013 |

* cited by examiner

CONTAINER FOR A WASTE HEAT UTILIZATION CIRCUIT

CROSS-REFERENCE TO RELATED APPLICATION

This application claims priority to International Application No. PCT/EP2016/068072 filed on Jul. 28, 2016, and to German Application No. DE 10 2015 215 063.1 filed on Aug. 6, 2015, the contents of each of which are hereby incorporated by reference in their entirety.

TECHNICAL FIELD

The invention relates to a container for a waste heat utilization circuit and a waste heat utilization circuit with such a container. The invention further relates to a waste heat utilization device with such a waste heat utilization circuit.

BACKGROUND

In internal combustion engines, in particular in piston engines, mechanical driving power is generated by burning a fuel. In so doing, a majority of the chemical energy contained in the fuel is released as heat, which frequently remains unused. Frequently, even a portion of the usable driving power must be used for cooling the internal combustion engine and its units. With a waste heat utilization device, the waste heat occurring in an internal combustion engine can be used, for example, in order to provide further driving power or electrical energy. Hereby, the overall energy efficiency of the internal combustion engine can be improved.

Such waste heat utilization devices are known for example from EP 2 573 335 A2 and from DD 136 280.

Waste heat utilization devices can be configured as a circuit process in the form of a so-called Carnot process. The so-called Clausius-Rankine process is a special Carnot process. In such a Clausius-Rankine process, a working medium circulates in a waste heat utilization circuit. In the waste heat utilization circuit there is situated an evaporator for evaporating the working medium, which extracts heat for this from the internal combustion engine. Downstream of the evaporator there is situated in the waste heat utilization circuit an expansion machine for the relieving of the working medium to a low pressure. Downstream of the expansion machine there is situated in the waste heat utilization circuit a condenser for the liquefying of the working medium. Downstream of the condenser, a compression machine is to be found in the waste heat utilization circuit for compressing the working medium to a high pressure. From the compression machine, the working medium arrives at the evaporator again. In relieving the pressure of the working medium in the expansion machine, thermal energy is converted into mechanical driving energy, which can be used directly as mechanical driving power, or can be converted into electrical energy by means of a generator. The heat for the evaporating of the working medium can be extracted for example from the waste gas of the internal combustion engine. A pump arranged downstream of the condenser in the waste heat utilization circuit serves for the conveying of the working medium.

It proves to be disadvantageous in such a conventional waste heat utilization circuit that undesired cavitation effects can be brought about through the working medium in the pump. These can lead to a damage to the components of the pump which are mechanically in contact with the working medium. In extreme cases, this can even result in a destruction of the pump.

It is therefore an object of the present invention to create a device for use in a waste heat utilization circuit, which counteracts the formation of undesired cavitation effects in the pump which is driving the working medium.

This problem is solved by the subject of the independent claim(s). Preferred embodiments are the subject of the dependent claims.

SUMMARY

Accordingly, a basic idea of the invention is to provide an equalization container for a waste heat utilization circuit—hereinafter designed as "container" for the sake of simplicity—which brings about a supercooling of the working medium, so that the latter flows as far as possible only in liquid phase through the pump. In this way, undesired cavitation effects can be prevented.

According to the invention, it is proposed to equip the container with a, preferably rigid, housing, which can be flowed through by a working medium of a waste heat utilization circuit. In the housing, in turn, a fluid-tight, heat-conductive and volume-variable sheath is arranged. This serves to vary the effective volume of the housing interior, delimited by the housing, which is of significant importance for the supercooling of the working medium which is aimed for. The working medium of the waste heat utilization circuit can be introduced directly into the housing. Whilst flowing through the housing, the working medium can enter into thermal interaction with the auxiliary medium via the heat-conductive sheath. Typically, the working medium on entry into the container has a higher temperature here than the auxiliary medium which is present, stationary, in the container. Owing to the heat-conductive characteristics of the sheath, heat is transferred from the warmer working medium to the colder auxiliary medium, until a temperature equilibrium occurs between working medium and auxiliary medium. When the temperature of the auxiliary medium reaches its boiling temperature here, the liquid phase of the auxiliary medium begins to evaporate at least partially. This leads to an enlargement of the sheath interior delimited by the sheath through expansion of the volume-variable sheath. This leads, in turn, to an increase in the pressure of the working medium, until an equilibrium has occurred in the auxiliary medium between liquid and gaseous phase. In this state of equilibrium, the fluid pressure of the working medium corresponds to the boiling pressure of the auxiliary medium. When the working medium and the now auxiliary medium are selected such that the boiling temperature of the auxiliary medium is less than that of the working medium, it can be permanently achieved that the working medium flows, as desired, in the liquid state of supercooling through the waste heat utilization circuit. In particular, it can be ensured that the desired supercooling level occurs without active assistance from outside.

When a working medium with reduced temperature arrives into the housing interior from a condenser of the waste heat utilization circuit upstream of the container, then the temperature of the auxiliary medium also decreases within a short time through heat transmission, and a portion of the gaseous phase contained therein condenses to the liquid phase, whereby the volume of the sheath interior is reduced. In so doing, a displacement of the working medium from the condenser into the container is brought about, whereby the supercooling is reduced. This takes place until the supercooling has again reached the desired extent.

When, on the other hand, working medium arrives in vapour form out from the condenser into the housing interior, then the fluid pressure increases immediately through the additional vapour volume, whereby the complete condensing is re-established at the condenser outlet automatically without the assistance of an external regulation, therefore without the assistance of an external regulation.

In operation of the waste heat utilization device, a vapour- and a liquid phase of the working medium can occur in the equalization container, integrated into the waste heat utilization circuit, such that a condensation pressure results, at which the supercooling of the working medium remains substantially constant. When a supercooled, liquid working medium arrives out from the condenser into the equalization container, a portion of the vapour contained therein condenses out, and the fluid pressure of the working medium in the equalization container decreases. When, on the other hand, vapour from the condenser arrives into the equalization container, the fluid pressure in the equalization container increases owing to the additional vapour volume. As a result, a complete condensing of the working medium is ensured on exit from the condenser, without an additional, external regulating mechanism being necessary for this. Through an arrangement of the pump immediately downstream of the equalization container, it can therefore be guaranteed that the working medium of the waste heat utilization circuit always enters into the pump in liquid form. This leads to no undesired cavitation being able to occur within the pump.

A container according to the invention for a waste heat utilization circuit comprises a housing which delimits a housing interior, and namely such that the housing interior can be flowed through by a working medium. For this, a fluid inlet and a fluid outlet can be provided at a suitable position on the housing. In the housing interior a sheath is arranged, in which an auxiliary medium is accommodated. Here, the sheath is fluid-tight and is designed at least in certain areas in a heat-conductive manner. The sheath delimits a sheath interior of variable volume. Any materials which permit heat transport between the two hosing interiors, necessary for the temperature equalization, within a few minutes, preferably within a few seconds, are understood here as being "heat-conductive".

In a preferred embodiment, the housing interior is at least partly filled by the working medium and/or is flowed through by the latter. Accordingly, the sheath is filled with an auxiliary medium, in a manner fluidically separated from the working medium, which auxiliary medium is present in the sheath interior in a gaseous and/or liquid state. In other words, the auxiliary medium can have in the sheath—depending on the current operating state of the container in the waste heat utilization circuit—a gaseous phase of a liquid phase, or both phases. Here, the boiling temperature of the auxiliary medium is preferably less by at least 10K, most preferably by at least 14K, than a boiling temperature of the working medium. The provision of an auxiliary medium with reduced boiling temperature compared to the working medium enables in a simple manner the supercooling of the working medium which is aimed for in operation in the waste heat utilization circuit.

To realize the volume-variability of the sheath interior, which is essential to the invention, it is proposed to provide the sheath with a membrane which is deformable in a fluid-tight and resilient manner. For this, preferably an elastomer, particularly preferably of a plastic, comes into consideration.

Particularly preferably, the sheath can be arranged so as to be freely movable in the, typically liquid, working medium present in the outer housing. This enables a particularly quick enlargement or respectively reduction of the volume of the sheath in the course of the heat transport between working medium and auxiliary medium.

According to a further preferred embodiment, the sheath is configured as a (first) bellows. Such a bellows permits a targeted expansion of the sheath along a predetermined direction, along which the material of the bellows, formed in a bellow-like manner, extends. This leads to a reduced installation space requirement for the container.

In an advantageous further development of the invention, a separating device is arranged in the housing interior, which divides the housing interior into a first partial space able to be flowed through by the working medium, and a second partial space which is fluidically separated from the first partial space. When the second partial space is fluidically connected to the external environment of the container by means of a pressure equalization opening provided in the housing, the effective volume of the container can be reduced for flowing through by the working medium on cold shutdown of the waste heat utilization circuit. Therefore, a sufficient fluid volume is always available for the flooding of the components of the waste heat utilization circuit, which can be filled with vapour in operation. On cold shutdown or on lowering of the condensation pressure below the ambient pressure, a portion of the working fluid present in the container can therefore be used for said flooding. By means of the second partial space, separated from the first partial space, an underpressure can be achieved here in the equalization container through pressure equalization. As a result, in this way, on cold shutdown an undesired contamination of the working medium with air, owing to leakage into the seals present in the waste heat utilization circuit, is prevented.

The separating device can be realized technically in a particularly simple manner by it being equipped with a separating element made of a fluid-tight and resiliently deformable material for varying the volume ratio of the two partial spaces with respect to one another.

In an alternative variant thereto, the separating device is configured as a (second) bellows or as part of such a (second) bellows. The simultaneous use of a first and a second bellows requires particularly little installation space.

A further preferred embodiment is to be produced with a particularly small number of components and consequently with particularly low manufacturing costs, in which the separating device, formed as second bellows, and a resilient membrane arranged in the second partial space are [part] of the sheath.

According to an advantageous further development, the second bellows is completed to the sheath by means of a resilient membrane. In this way, a particularly great variability of the volume of the sheath can be realized.

A further advantageous further development requires particularly little installation space, according to which the separating device comprises a separating element made of a fluid-tight and resiliently deformable material for varying the volume ratio of the two partial spaces relative to one another. Said separating element is fastened to the housing together with a further resilient and heat-conductive membrane, and divides the housing interior into three partial spaces. In this scenario, the separating element and the membrane are part of the sheath, and namely such that the third partial space is the sheath interior delimited by the sheath.

Another advantageous further development of the invention is particularly simple to produce, according to which the two membranes are fastened internally to a shared housing wall of the housing. In this variant, the fastening preferably takes place such that the shared housing wall forms both a part of the housing and also of the sheath.

In another preferred embodiment, the sheath is delimited by the first bellows. The separating device has a separating element of a resilient and fluid-tight material, wherein the first bellows is arranged in the first partial space.

Particularly expediently, the working medium can be ethanol and the auxiliary medium can be methanol. As their boiling temperature differs by approximately 14K, these two media are particularly suitable for ensuring the desired supercooling of the working medium.

In another preferred embodiment, the housing has a fluid inlet for introducing the working medium into the first partial space, and a fluid outlet present at the housing for directing the working medium out from the first partial space. Preferably here at least the fluid outlet is arranged in a lower region of the housing, particularly preferably in a housing base of the housing. The term "lower region" refers here to the position of use of the container in the waste heat utilization circuit. These provisions, in isolation or in combination, are intended to ensure that the working medium is only present in liquid phase when it is removed from the container via the fluid outlet.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
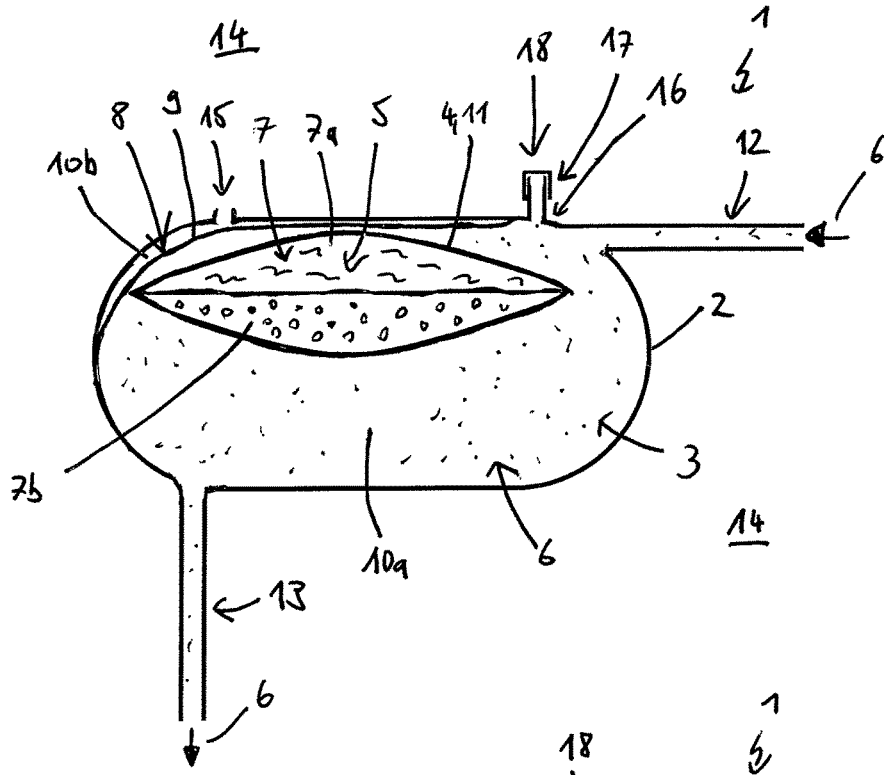
FIGS. 1 to 7 illustrate various examples for a container according to the invention, FIG. 8 in diagrammatic representation the structure of a waste heat utilization circuit of a waste heat utilization device, into which the container according to the invention is integrated.

FIG. 1 illustrates a first example of a container 1 according to the invention, as it can be operated in a waste heat utilization circuit 50 of a waste heat utilization device of a motor vehicle. The container 1 has a mechanically rigid housing 2, which delimits a housing interior 3 with a predetermined volume. The housing interior 3 is flowed through by a working medium 6. The latter can be introduced into the housing interior 3 via a fluid inlet 12 provided on the housing 2, and can be directed out from the housing interior 3 again via a fluid outlet 13, likewise provided on the housing 2.

A separating device 8 is arranged in the housing interior 3. The separating device 8 divides the housing interior 3 into a first partial space 10*a*, which is able to be filled with the working medium 6, and a second partial space 10*b*, which is fluidically separated from the first partial space 10*a*. The fluid inlet 12 and the fluid outlet 13 are fluidically connected here to the first partial space 10*a*. The separating device 8 comprises a separating element 9 made of a fluid-tight and resilient material for varying the volume ratio of the two partial spaces 10*a*, 10*b* with respect to one another. The separating element 9 can be realized as a membrane and can comprise, for example, an elastomer. The separating element 9 can be fastened directly, therefore without further fastening means, by means of an adhesive connection on the inner side to the housing 2. Instead of a direct fastening by means of an adhesive connection, alternatively also the use of another fastening method, for example a clamping- or screwed connection, is conceivable. In this case, it is necessary to equip the separating device 8 with suitable fastening elements, by means of which said clamping- or respectively screwed connection of the separating element 9 to the housing 2 can be realized.

As can be seen in FIG. 1, in the housing 2 of the container 1 an opening 15 is present for pressure equalization, which opening connects the second partial space 10*b* fluidically to the external environment 14 of the container 1, so that the fluid pressure in the second partial space 10*b* always corresponds to the fluid pressure in the external environment 14. In addition, a filling- and venting opening 16 is provided in the housing 2, with a filling- and venting connecting piece 17 protruding outwards from the housing 2 away from the housing interior 3. The filling- and venting opening 16 connects the first partial space 10*a* of the housing interior 3 fluidically to the external environment 14 of the container 1. The filling- and venting connecting piece 17 can be closed by means of a suitably constructed sealing cap 18. In the first partial space 10*a* of the housing interior 3 in addition a sheath 4 is arranged, which is fluid-tight and designed at least in certain areas in a heat-conductive manner. The sheath 4 delimits a sheath interior 5 of variable volume, in which an auxiliary medium 7 is arranged. The sheath 4 can be configured as a fluid-tight and resilient membrane 11, as indicated diagrammatically in FIG. 1. For this purpose, the membrane 11 has a resilient material, which comprises a heat-conductive material for the temperature equalization between the working medium 6 and the auxiliary medium 7. An elastomer also comes into consideration in an analogous manner to the separating element.

As FIG. 1 shows, the auxiliary medium 7 is present in the sheath interior 5 both in a gaseous phase 7*a* and also in a liquid phase 7*b*. The boiling temperature of the auxiliary medium 7 has a value lower by 10K, preferably by at least 14K, than the boiling temperature of the working medium 6. The working medium is therefore preferably ethanol, the auxiliary medium ethanol.

In the state shown in FIG. 1, the working medium 6 and the auxiliary medium 7 have an approximately identical temperature. This state can be brought about through heat transport through the heat-transferring membrane 11 from the originally hotter working medium 6 to the originally cooler auxiliary medium. Through said heat absorption through the auxiliary medium 7, the latter forms the partially liquid phase 7*b* shown in FIG. 1. This, in turn, is accompanied by an increase in the fluid pressure of the working medium 6, until an equilibrium between liquid phase 7*a* and gaseous phase 7*b* occurs in the sheath interior 5 delimited by the membrane 11. The fluid pressure of the working medium 6 in the housing interior 3 corresponds then to the boiling temperature of the auxiliary medium 7 in the sheath interior 5. In this way, it is ensured that in the working medium 6—in particular without active assistance from the exterior—the desired supercooling level always occurs for the operation in a waste heat utilization circuit 50: When a working medium 6 with reduced temperature arrives into the housing interior 3 out from a condenser of the waste heat utilization circuit, upstream of the container 1, then through heat transmission the temperature of the auxiliary medium 7 also decreases within a short time, and a portion of the gaseous phase 7*a* contained therein condenses out to the liquid phase 7*b*. Accompanying this, the fluid pressure of the auxiliary medium 7 reduces, and therefore also that of the working medium 6. This takes place until the supercooling of the working medium 6 has reached the desired extent again. When, on the other hand, the working medium 6 arrives with a high temperature and therefore in gaseous form, therefore in the form of vapour, out from the condenser into the housing interior 3, then the fluid pressure of working medium 6 and auxiliary medium 7 increases, so that the complete condensing is brought about automatically at the condenser outlet, therefore without the assistance of an external regulation.

Figure 2:
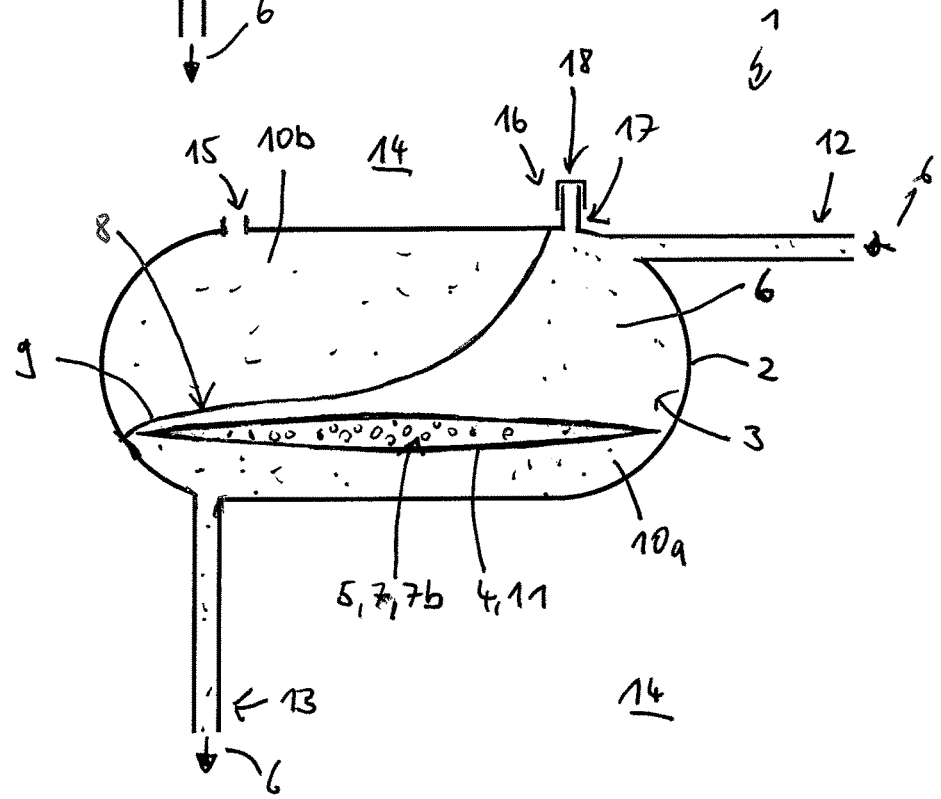

FIG. 1 shows the container 1 in the desired state of supercooling of the working medium. By comparison, FIG. 2 shows the container of FIG. 1 in the so-called cold shutdown of the waste heat utilization device 50 using the container 1. In order to prevent a contamination of the working fluid 6 with air owing to leakages in seals on the cold shutdown of the waste heat utilization device 50, the occurrence of an underpressure in the housing interior 3 must be prevented as far as possible. This occurs by means of the second partial space 10*b*, which is fluidically connected to the external environment 14 of the container 1, so that the volume of the first partial space 10*a* in the course of any drop in pressure which occurs in the first partial space 10*a* can be immediately reduced. In this way, the components of the waste heat utilization circuit 51 of the waste heat utilization device 50 which are filled with the working medium 6 in gaseous phase in operation, can be flooded with the working medium 6 in liquid phase.

Therefore, when the fluid pressure in the first partial space 10*a* falls below a minimum permissible swelling pressure, then the first partial volume 10*a* contracts by means of the flexible separating device 8, so that the underpressure which has occurred can reduce again. In order to prevent said underpressure in the container 1, the second partial space 10*b* is in contact with the external environment 14 via the opening 15, so that a pressure equalization is possible. As a comparison of FIG. 2 with the illustration of FIG. 1 shows, by movement of the separating element 9 away from the housing wall of the housing 2, the volume of the second partial space 10*b* is increased compared to the state of FIG. 1, and that of the first partial space 10*a* is reduced. It can be seen, furthermore, from FIG. 2 that owing to the pressure reduction of the fluid pressure in the first partial space 10*a*, the volume of the sheath interior 5 delimited by the sheath 4 also decreases, so that the gas phase 7*a* of the auxiliary medium 7, still present in the state of FIG. 1, condenses out completely.

Figure 3:
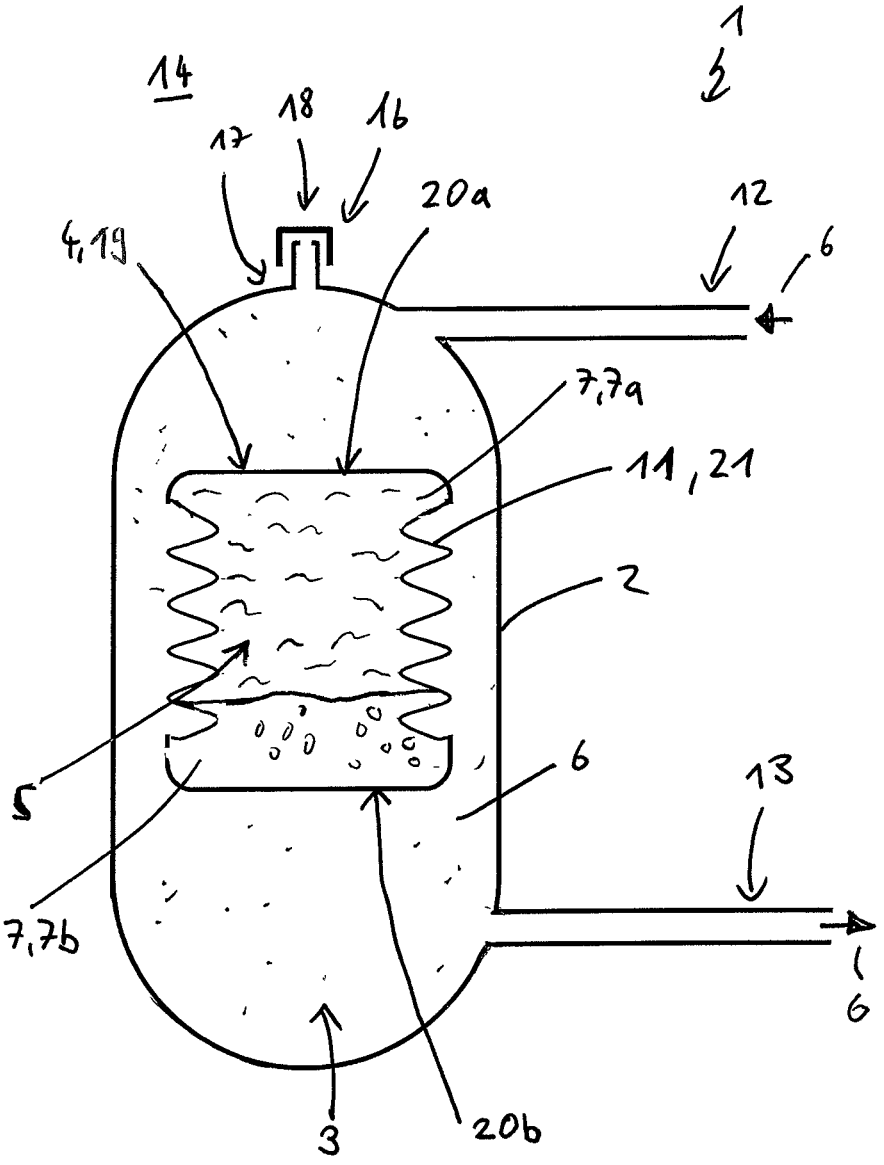

FIG. 3 shows a variant of the container 1 of FIGS. 1 and 2. In the example of FIG. 3 the sheath 4 is configured in the manner of a (first) bellows 19. Furthermore, in the container of FIG. 3 the separating device 8 for the formation of two partial spaces 10*a*, 10*b* is dispensed with, so that also no opening 15 for pressure equalization is provided on the housing 2. As FIG. 3 clearly shows, the bellows 19 has a first bellows end wall 20*a* and a second bellows end wall 20*b* lying opposite the first bellows end wall 20*a*. The two bellows end walls 20*a*, 20*b* delimit on the face side the bellows 19 which is configured substantially in the manner of a cylinder. The two bellows end walls 20*a*, 20*b* are connected by means of the resilient and heat-conductive membrane 11 already known from FIG. 1. The membrane 11 forms a circumferential wall 21 of the substantially cylindrical bellows 19. Said circumferential wall 21 can be fastened by means of a fluid-tight adhesive connection to the two bellows end walls 20*a*, 20*b*. Alternatively thereto, other suitable fastening methods come in consideration, in particular a screwed or clamping connection.

Figure 4:
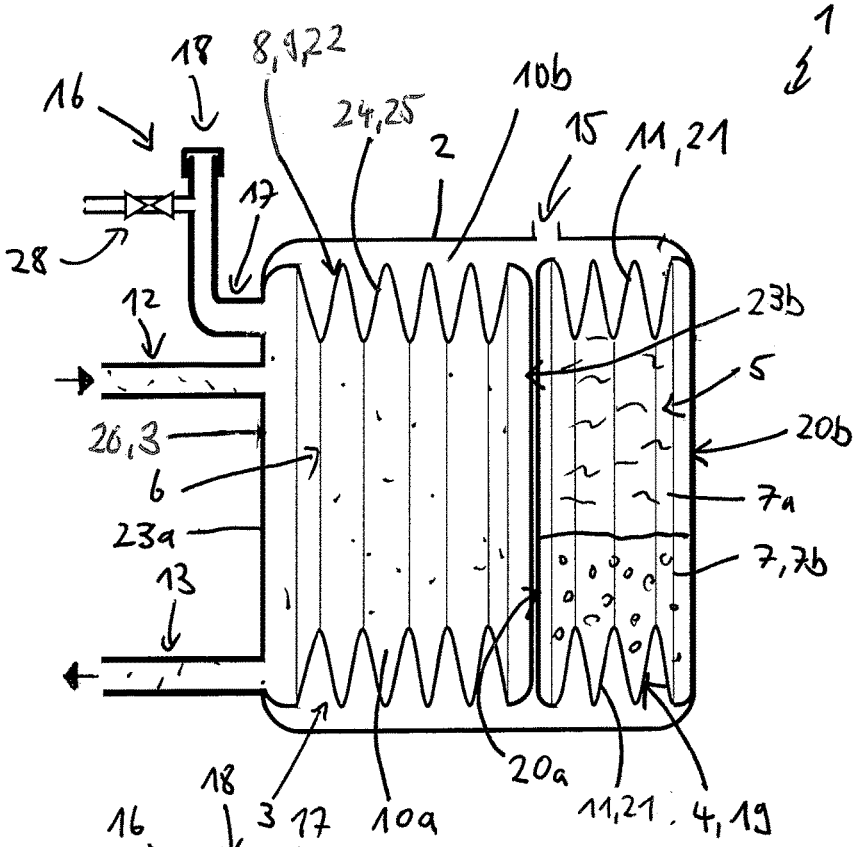

The container 1 according to FIG. 4 is a further development of the example of FIG. 3. In the container of FIG. 4, in addition to the sheath 4 configured as a first bellows 19, the separating device 8 is also configured as a second bellows 22. The volume delimited by the second bellows 22 forms the first partial space 10*a*, the region of the housing interior 3 complementary thereto forms the second partial space 10*b*. In the example of FIG. 4, the first bellows 19 is arranged in the second partial space 10*b*.

In accordance with FIG. 4, the second bellows 21 also forms a first bellows end wall 23*a*, and a second bellows end wall 23*b* lying opposite thereto. The two bellows end walls 23*a*, 23*b* delimit on the face side the second bellows 22 configured substantially in the manner of a cylinder. The two bellows end walls 23*a*, 23*b* are connected to one another by means of the separating element 9 of the separating device 8, therefore of the second bellows 22, in the form of a fluid-tight membrane 24. For this, the separating element 9 is configured as a resilient circumferential wall 25 delimiting the second bellows 22 on the circumferential side. The circumferential wall 25 can be fastened to the two end walls 23*a*, 23*b* by means of a fluid-tight adhesive connection. Alternatively thereto, the fastening methods for the first bellows 19, named in connection with the example of FIG. 3, also come into consideration, therefore in particular a screwed or clamping connection.

In the example of FIG. 4, in an analogous manner to the container of FIGS. 1 and 2, a fluid inlet 12 and a fluid outlet 13 are provided on the housing 2, which are both in fluid connection with the volume delimited by the second bellows 22, therefore the first partial space 10*a*. As can be seen from FIG. 4, the end walls 20*a* and 23*b* of the two bellows 19, 22 can lie opposite one another. The end wall 23*a*, as shown in FIG. 4, can be formed by a housing wall 26 of the housing 2, or the end wall 23*a* can be fastened, for instance by means of an adhesive connection, flat against this housing wall 26.

Furthermore, on the housing 2 of FIG. 4, in an analogous manner to the container of FIGS. 1 and 2, a filling- and venting opening 16 is provided, having a filling- and venting connecting piece 17 protruding outwards from the housing 2, away from the housing interior 3. The filling- and venting opening 16 fluidically connects the first partial space 10*a* of the housing interior 3 to the external environment 14 of the container 1. The filling- and venting connecting piece 17 can be closed in a sealing manner by means of a sealing cap 18. The container 1 according to FIG. 4 has an opening 15, which fluidically connects the second partial space 10*b* to the external environment 14 of the container for the purpose of pressure equalization. A pressure relief valve 28 can be constructed on the filling- and venting connecting piece 17.

Figure 5:
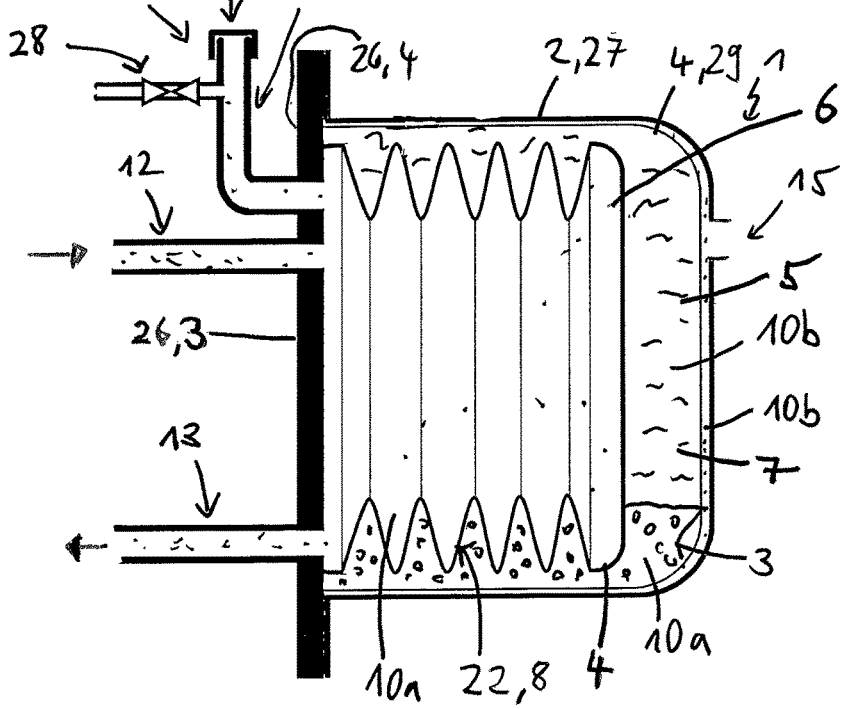

FIG. 5 shows a further technical realization possibility for the container 1. In this variant, the separating device 8, configured as a (second) bellows 22, is part of the sheath 4. A resilient membrane 29, which is arranged in the second partial space 10*b*, and a housing wall 26 of the housing 2 complete the part of the (second) bellows 22, which is part of the sheath 4, to the sheath 4.

Figure 6:
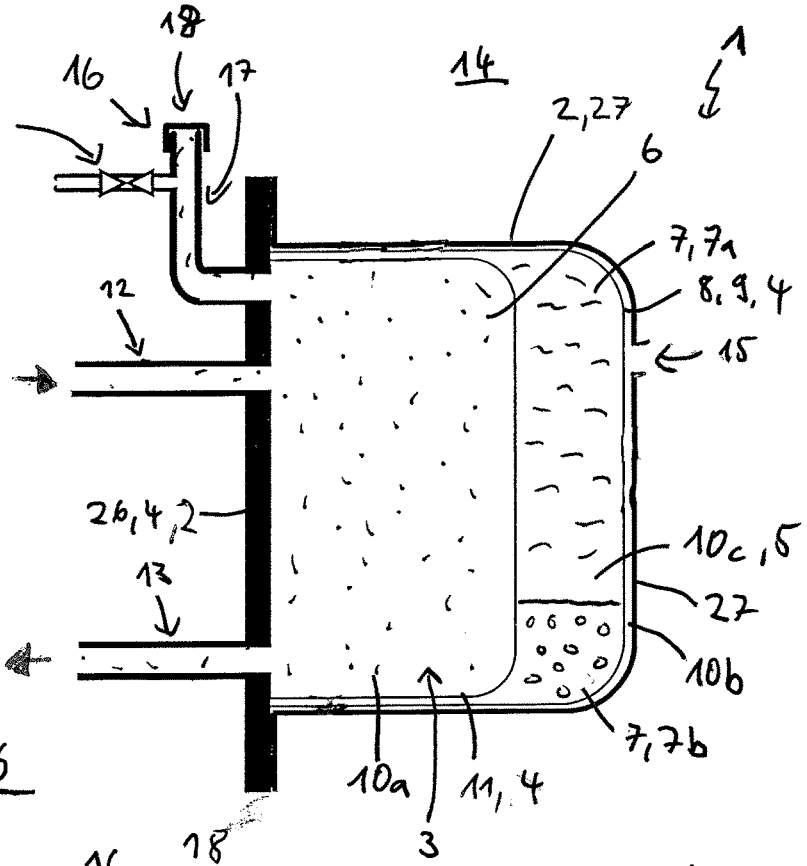

In a further variant, which is illustrated in FIG. 6, the separating device 8 comprises a separating element 9 made of a fluid-tight and resiliently deformable material for varying the volume ratio of the two partial spaces 10*a*, 10*b* relative to one another. The separating element 9 is fastened to the housing 2 together with a further resilient and heat-conductive membrane 11, and divides the housing interior 3 into three partial spaces 10*a*, 10*b*, 10*c*. The separating element 9 and the membrane 11 are part of the sheath 4. The third partial space 10*c* forms the sheath interior 5 delimited by the sheath 4. The fastening of separating element 9 and membrane 11 can take place such that the shared housing wall 26, as illustrated in FIG. 6, forms both a part of the housing 2 and also of the sheath 4.

Figure 7:
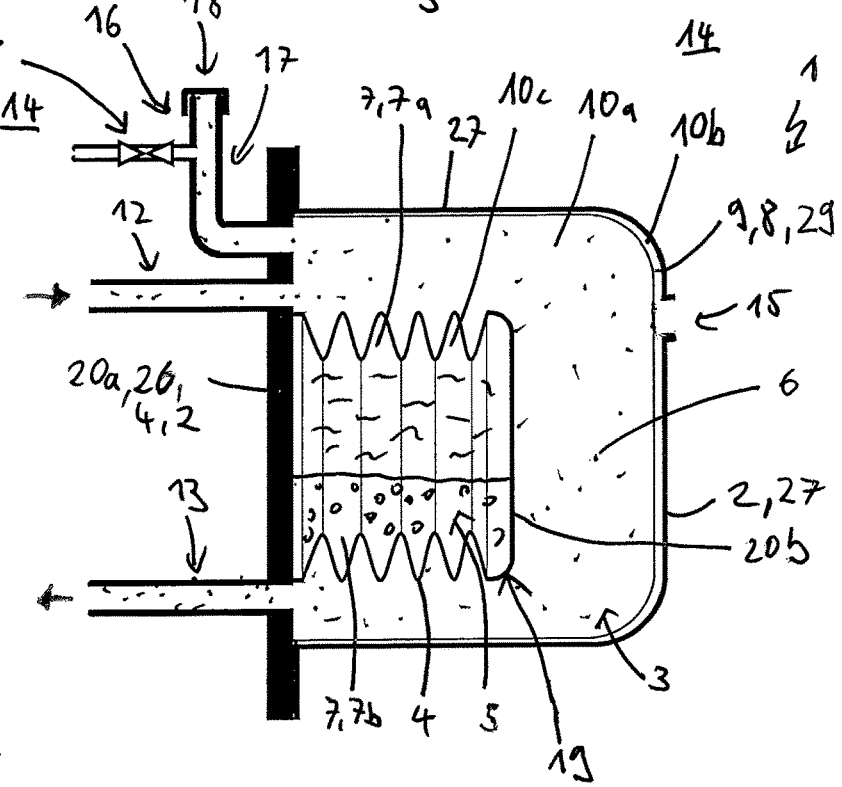

In the variant according to FIG. 7, the membrane 11 is replaced by a first bellows 19, which with regard to its structure corresponds substantially or exactly to the bellows 19 of FIG. 3. The sheath 4 is formed by the bellows 19, as in the example of FIG. 3. The separating device 8 is configured in an analogous manner to FIG. 6 and is realized as membrane 29 from a resilient and fluid-tight material. As FIG. 7 shows, the first bellows 19 is arranged in the first partial space 10*a*. The bellows end wall 20*a* of the bellows 19 can be formed by the housing wall 26 of the housing 2. Alternatively, said bellows end wall 20*a* can, however, also be fastened internally on the housing wall 26, for example by means of a flat adhesive connection.

In the example of FIGS. 5 to 7, the housing 2 is configured in a pot-like manner with a housing pot 27, which is closed by the housing wall 26, so that the housing wall 26 acts in the manner of a cover.

Figure 8:
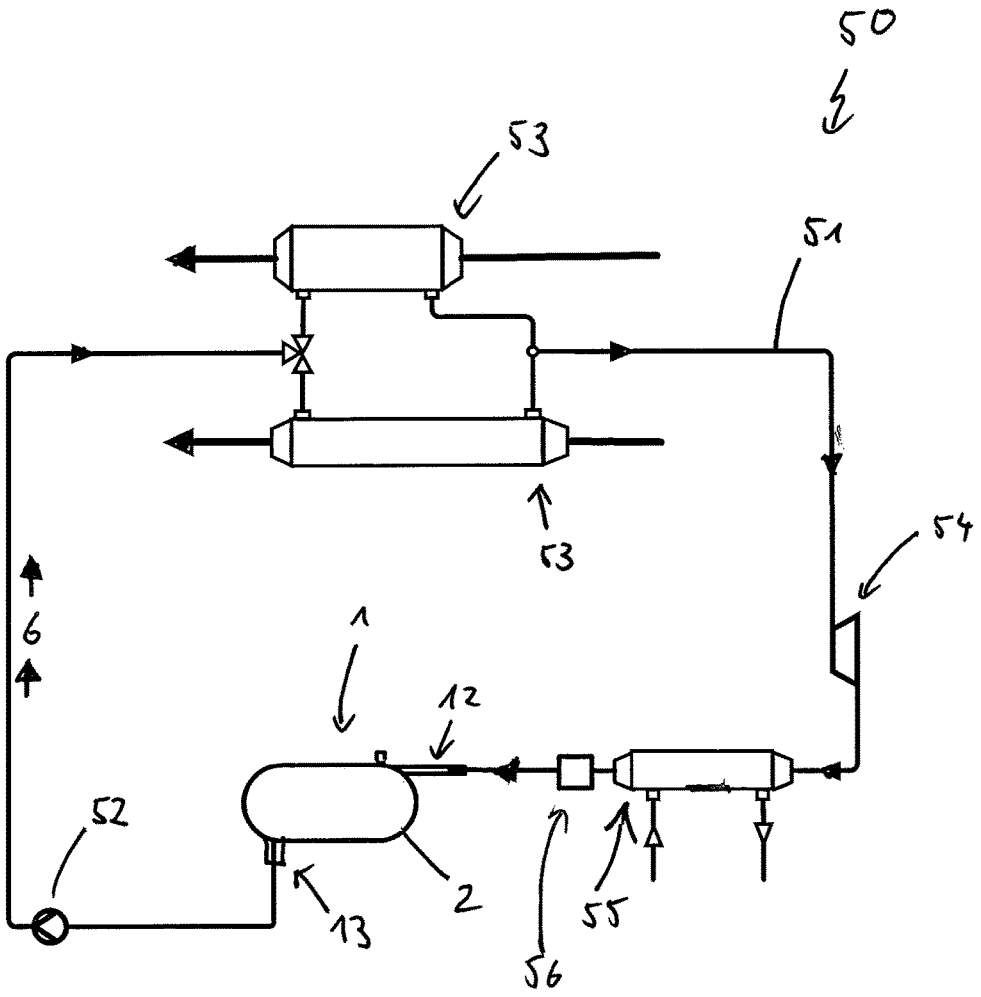

FIG. 8 shows diagrammatically the structure of a waste heat utilization device with a waste heat utilization circuit 51, in which the previously presented container 1 is arranged, and in which the working medium 6 circulates. In the waste heat utilization circuit 51, a conveying device 52 in the form of a conveyor pump for conveying the working medium 6 is arranged downstream of the container 1. Downstream of the conveying device 52, two evaporators 53 are arranged, in which the working medium 6 is evaporated. Downstream of the evaporators 53, an expansion machine 54 is arranged. Downstream of the expansion machine 54, a condenser 55 is provided, which is followed by the container 1, so that the waste heat utilization circuit 51 forms a closed circuit. Between the condenser 55 and the container 1, a filter device 56 can be optionally provided for filtering the working medium 6.

The invention claimed is:

1. A container for a waste heat utilization circuit, comprising:

a housing delimiting a housing interior such that the housing interior can be flowed through by a working medium;

a sheath arranged in the housing interior for accommodating an auxiliary medium, wherein the sheath is fluid-tight and is heat-conductive at least in certain areas, and the sheath delimits a sheath interior of variable volume; and wherein the housing interior is at least one of at least partially filled with the working medium and flowed through by the working medium, and the sheath interior is filled with the auxiliary medium in at least one of a gaseous state and a liquid state, and wherein a boiling temperature of the auxiliary medium has a lower value than a boiling temperature of the working medium.

2. The container according to claim 1, wherein the sheath includes a heat-conductive material at least in certain areas for temperature equalization between the working medium and the auxiliary medium.

3. The container according to claim 1, wherein the sheath includes a fluid-tight and resilient membrane.

4. The container according to claim 1, wherein the sheath is arranged freely movable in the working medium disposed in the housing.

5. The container according to claim 1, wherein the sheath is configured as a bellows.

6. The container according to claim 1, further comprising a separating device arranged in the housing interior, the separating device dividing the housing interior into a first partial space where the working medium is flowable, and a second partial space fluidically separated from the first partial space; and wherein the housing includes an opening for pressure equalization, the opening structured and arranged to fluidically connect the second partial space of the housing interior to an external environment.

7. The container according to claim 6, wherein the separating device includes a separating element composed of a fluid-tight and resiliently deformable material for varying a volume ratio of the first partial space and the second partial space relative to one another.

8. The container according to claim 1, further comprising a separating device arranged in the housing interior and separating the housing interior into a first partial space that receives the working medium and a second partial space fluidically separated from the first partial space, wherein the separating device includes a bellows.

9. The container according to claim 8, wherein the bellows of the separating device and a resilient membrane arranged in the second partial space are part of the sheath.

10. The container according to claim 9, wherein the separating device includes a separating element composed of a fluid-tight and resiliently deformable material for varying a volume ratio of the first partial space and the second partial space relative to one another;

wherein the separating element is secured to the housing and together with a further resilient and heat-conductive membrane divides the housing interior into three partial spaces; and wherein the separating element and the further membrane are part of the sheath, such that a third partial space is the sheath interior delimited by the sheath.

11. The container according to claim 10, wherein the separating element and the further membrane are secured internally to a shared housing wall of the housing, such that the shared housing wall defines both a part of the housing and a part of the sheath.

12. The container according to claim 5, wherein the sheath is delimited by the bellows, and a separating device arranged in the housing interior has a separating element composed of a resilient and fluid-tight material, and wherein the bellows is arranged in a first partial space of the housing interior separated from a second partial space via the separating device.

13. The container according to claim 1, wherein at least one of (i) the boiling temperature of the auxiliary medium is at least 10K lower than the boiling temperature of the working medium, and (ii) the working medium is ethanol and the auxiliary medium is methanol.

14. The container according to claim 6, wherein the housing includes a fluid inlet for introducing the working medium into the first partial space, and a fluid outlet for directing the working medium out from the first partial space; and wherein at least the fluid outlet is arranged in a lower region of the housing.

15. A waste heat utilization circuit, comprising:

a conveying device for conveying a working medium;

an evaporator for evaporating the working medium;

an expansion machine; and an equalization container, the equalization container including:

a housing defining a housing interior that is flowable through by the working medium;

a sheath arranged in the housing interior, the sheath defining a sheath interior of variable volume that accommodates an auxiliary medium, wherein the sheath is fluid-tight and is heat-conductive at least in certain areas; and wherein the housing interior is at least one of at least partially filled with the working medium and flowed through by the working medium, and the sheath interior is filled with the auxiliary medium in at least one of a gaseous state and a liquid state, and wherein a boiling temperature of the auxiliary medium has a lower value than a boiling temperature of the working medium.

16. A waste heat utilization device, comprising: a waste heat utilization circuit for circulating a working medium, the waste heat utilization circuit including:

a conveyor pump for conveying the working medium;

an evaporator for evaporating the working medium;

an expansion machine; and an equalization container, the equalization container including:

a housing defining a housing interior that is flowable through by the working medium;

a sheath arranged in the housing interior and defining a sheath interior of variable volume for accommodating an auxiliary medium, wherein the sheath is fluid-tight and is heat-conductive at least in certain areas;

a separating device arranged in the housing interior, the separating device dividing the housing interior into a first partial space where the working medium is flowable, and a second partial space fluidically separated from the first partial space; and wherein the housing includes a pressure equalization opening structured and arranged to fluidically connect the second partial space of the housing interior to an external environment.

17. The waste heat utilization device according to claim 16, wherein the first partial space of the housing interior is at least one of at least partially filled with the working medium and flowed through by the working medium, and the sheath interior is filled with the auxiliary medium in at least one of a gaseous state and a liquid state, and wherein a boiling temperature of the auxiliary medium is at least 10K lower than a boiling temperature of the working medium.

18. The waste heat utilization circuit according to claim 15, further comprising a separating device arranged in the housing interior, the separating device dividing the housing interior into a first partial space where the working medium is accommodated, and a second partial space fluidically separated from the first partial space; and wherein the housing includes a filling and venting opening structured and arranged to fluidically connected the first partial space of the housing interior to an external environment, the filling and venting opening including a connecting piece protruding outwards from the housing away from the housing interior and a sealing cap structured and arranged to close the connecting piece.

19. The waste heat utilization circuit according to claim 15, wherein:

the conveying device conveys the working medium in a flow direction and is arranged downstream of the equalization container relative to the flow direction;

the evaporator is arranged downstream of the conveying device;

the expansion machine is arranged downstream of the evaporator; and the equalization container is arranged between the expansion machine and the conveying device relative to the flow direction, the equalization container including a fluid inlet that receives the working medium flowing downstream of the expansion machine and a fluid outlet that communicates the working medium to the conveying device.

20. The container according to claim 6, wherein the housing further includes a filling and venting opening structured and arranged to fluidically connected the first partial space of the housing interior to the external environment, the filling and venting opening being closeable via a sealing cap.

* * * * *